US006922848B1

(12) United States Patent
Stanley

(10) Patent No.: US 6,922,848 B1
(45) Date of Patent: Aug. 2, 2005

(54) COSTUME

(76) Inventor: Virgil E. Stanley, 5860 N. Michigan Rd., Indianapolis, IN (US) 46228

( * ) Notice: Subject to any disclaimer, the term of this patent is extended or adjusted under 35 U.S.C. 154(b) by 0 days.

(21) Appl. No.: 10/353,288

(22) Filed: Jan. 29, 2003

(51) Int. Cl.[7] ..... A41D 1/00
(52) U.S. Cl. ..... 2/69; 2/244; 2/246
(58) Field of Search ..... 2/69, 69.5, 84, 2/88, 115, 80, 83, 244, 246, 108, 90, 93, 105, 106, 85; D2/725, 733–735, 741, 745, 746, 764, 772, 776, 783, 777, 784, 788, 809, 818; 446/26–28, 174, 321, 97–100; 428/15–19; 434/267, 395, 396, 309, 393, 219, 226; 40/586

(56) References Cited

U.S. PATENT DOCUMENTS

| | | | | | |
|---|---|---|---|---|---|
| 966,127 | A | * | 8/1910 | Samstag | 446/321 |
| D51,303 | S | * | 9/1917 | Hincks | |
| 2,686,313 | A | * | 8/1954 | Seidler | 40/586 |
| 4,498,199 | A | * | 2/1985 | Margolis | 2/69 |
| 4,591,521 | A | * | 5/1986 | Freno et al. | 2/80 |
| D285,815 | S | * | 9/1986 | Finn | 2/84 |
| 4,928,321 | A | * | 5/1990 | Dobson | 2/84 |
| 4,980,929 | A | * | 1/1991 | Long | 2/125 |
| 5,197,216 | A | * | 3/1993 | Norris | 446/26 |
| 5,209,691 | A | * | 5/1993 | Ekstein | 446/28 |
| 5,542,122 | A | * | 8/1996 | Moldovan | 2/69 |
| 5,901,372 | A | * | 5/1999 | Lawler | 2/69 |
| 5,933,866 | A | * | 8/1999 | Fox | 2/115 |
| 6,173,450 | B1 | * | 1/2001 | Hari | 2/69 |
| 6,401,249 | B2 | * | 6/2002 | Haar et al. | 2/69 |

OTHER PUBLICATIONS

Simplicity Patten Catalog #8033, Oct., 1992; pp. 355,–Pattern #7984; p. 383– Pattern #7475; p. 388–#9305; p. 393–7527+ entire pages.*

* cited by examiner

*Primary Examiner*—Gloria M. Hale
(74) *Attorney, Agent, or Firm*—Coats & Bennett, P.L.L.C.

(57) ABSTRACT

A costume is provided and includes a main body portion having a neck opening and a hood extending from the main body portion adjacent the neck opening. Main body portion includes a front panel and a back panel. Secured on the front panel is a head, such as the head of a bumblebee. When worn, the head is disposed below the hood and projects outwardly from the front of the main body portion. The head is also 3-dimensional and includes an outer surface that tends to be round, and includes a face with a pair of eyes and a nose. Projecting rearwardly from the back of the main body portion is a tail and a pair of wings.

12 Claims, 4 Drawing Sheets

COSTUME

FIELD OF THE INVENTION

The present invention relates to costumes and more particularly to a costume that includes a head that, when the costume is worn is disposed below the head of the person wearing the costume.

BACKGROUND OF THE INVENTION

Costumes are tremendously popular today throughout the United States and the world. Halloween has become a special occasion enjoyed and participated in by not only children but people of all ages. In addition to Halloween, costumes are worn and celebrated at costume parties, festivals and carnivals all over the world.

As the popularity of Halloween and other costume type festivals has increased, the awareness of costume design as an art has also increased. Today, there are many professionals that work tirelessly to create new and innovative costumes that will be accepted by the public. There are, however, many challenges in costume designs. There is no doubt that costume designers have to be creative and incorporate imagination into their designs. In the end, costume designers are attempting to create unique and fanciful animals and caricatures that will attract interest and attention. However, costume designers are always confronted with designing practical and cost effective costumes that have significant wearability characteristics, especially for children. For the costume designer, the challenge, especially in the case of children's costumes, is to present a costume that is easily worn and where the presence of the child not only does not detract from the presentation of the costume, but in fact enhances the same.

SUMMARY OF THE INVENTION

The present invention relates to a costume having a main body portion that includes a front and a back. A hood extends from the main body portion and includes a face opening. A head is secured to the front of the main body portion below the hood. The head projects from the front of the main body portion and includes an outer surface with a face formed thereon.

In another embodiment, the costume includes a main body portion having a front and a back, and a neck opening. A head is secured to the front of the main body portion below the neck opening. The head projects from the front of the main body portion and includes an outer surface and a face.

In other embodiments of the present invention, the costume includes a tail and/or a pair of wings that project from the back.

With respect to the head, the head is 3-dimensional and projects out from the front of the main body of the costume. That is, the head, separate and apart from the front of the main body, includes a height, width and a depth.

Other objects and advantages of the present invention will become apparent and obvious from a study of the following description and the accompanying drawings, which are merely illustrative of such invention.

DESCRIPTION OF EXEMPLARY EMBODIMENT

Figure 1:
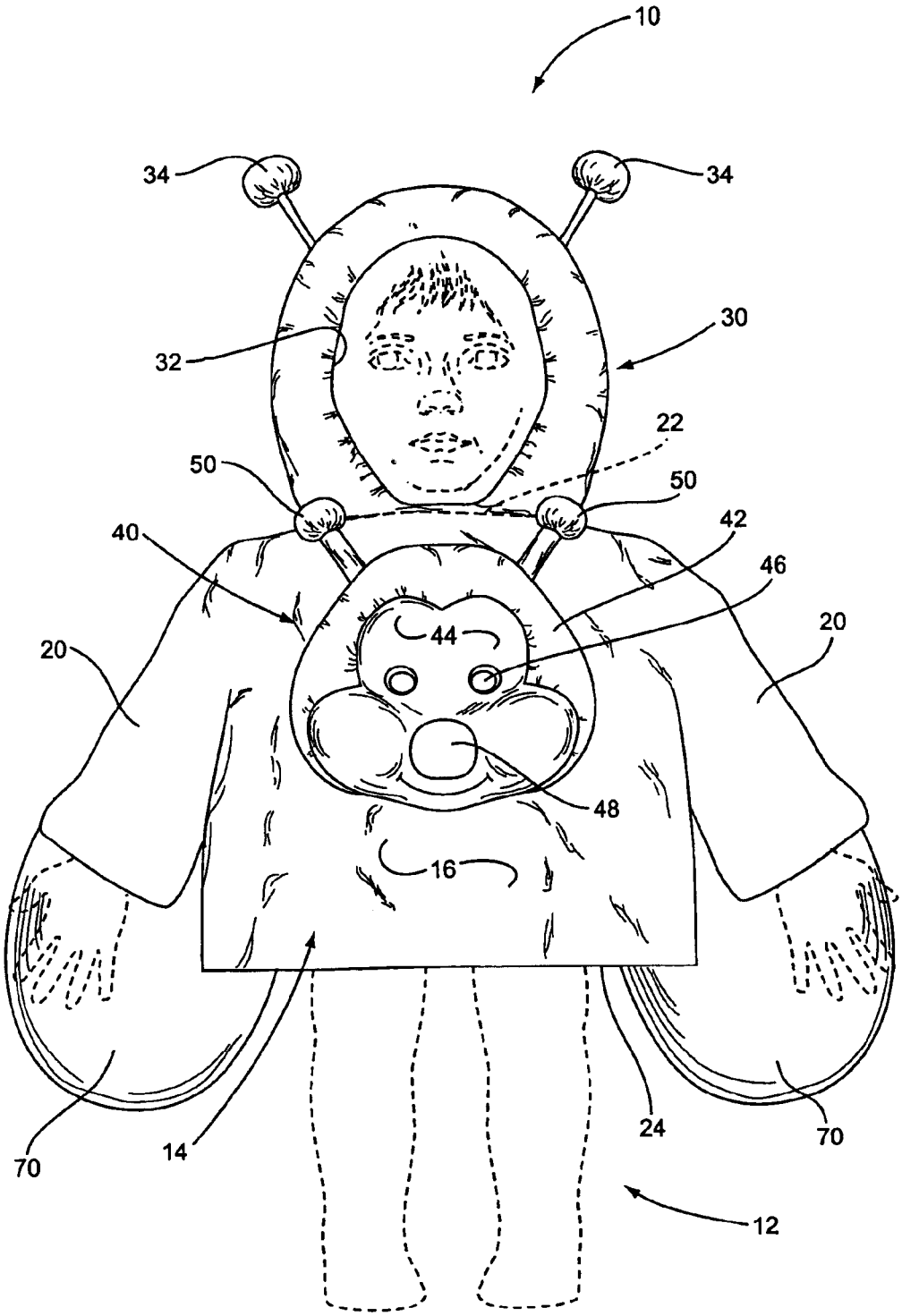
FIG. 1 is a front elevational view of the costume.

With further reference to the drawings, the costume 10 of the present invention is shown therein and indicated generally by the numeral 10. As illustrated, costume 10 is shown in a worn state and as illustrated in the drawings, the costume is shown being worn by a child indicated generally by the numeral 12.

Viewing costume 10 in more detail, it is seen that the same includes a main body portion indicated generally by the numeral 14. Main body portion 14 includes a front 16 and a back 18. Extending from each side of the main body portion is an arm 20. It should be appreciated, that the arms 20 are optional as the costume 10 could be sleeveless. Formed about the top of the main body portion 14 is a neck opening 22. The neck opening accommodates the neck area of the child 12. Formed above the lower area of the main body portion 14 is a bottom 24. In the embodiment illustrated herein, the main body portion is generally considered an upper garment as the same does not extend down to the ankles or feet of the child 12. However, it is appreciated that the main body portion may include a lower garment, which would extend to either the feet, ankles or just above the ankles of the child 12. For example, costume 10 of the present invention could be in the form of a jump suit, a separate upper and lower garment, or a combination upper and lower garment where the upper and lower portions of the garment are secured together. Further, the main body portion 12 may be in the form of a pullover or could be provided with a zipper entry disposed at various locations around the main body portion.

Extending from the main body portion 14 is a hood indicated generally by the numeral 30. Hood 30 basically extends from the neck opening 22 of the costume 10. In the drawings, it is shown where the hood 30 includes a face opening 32 and a pair of antennas 34 that project outwardly from the hood 30.

Figure 2:
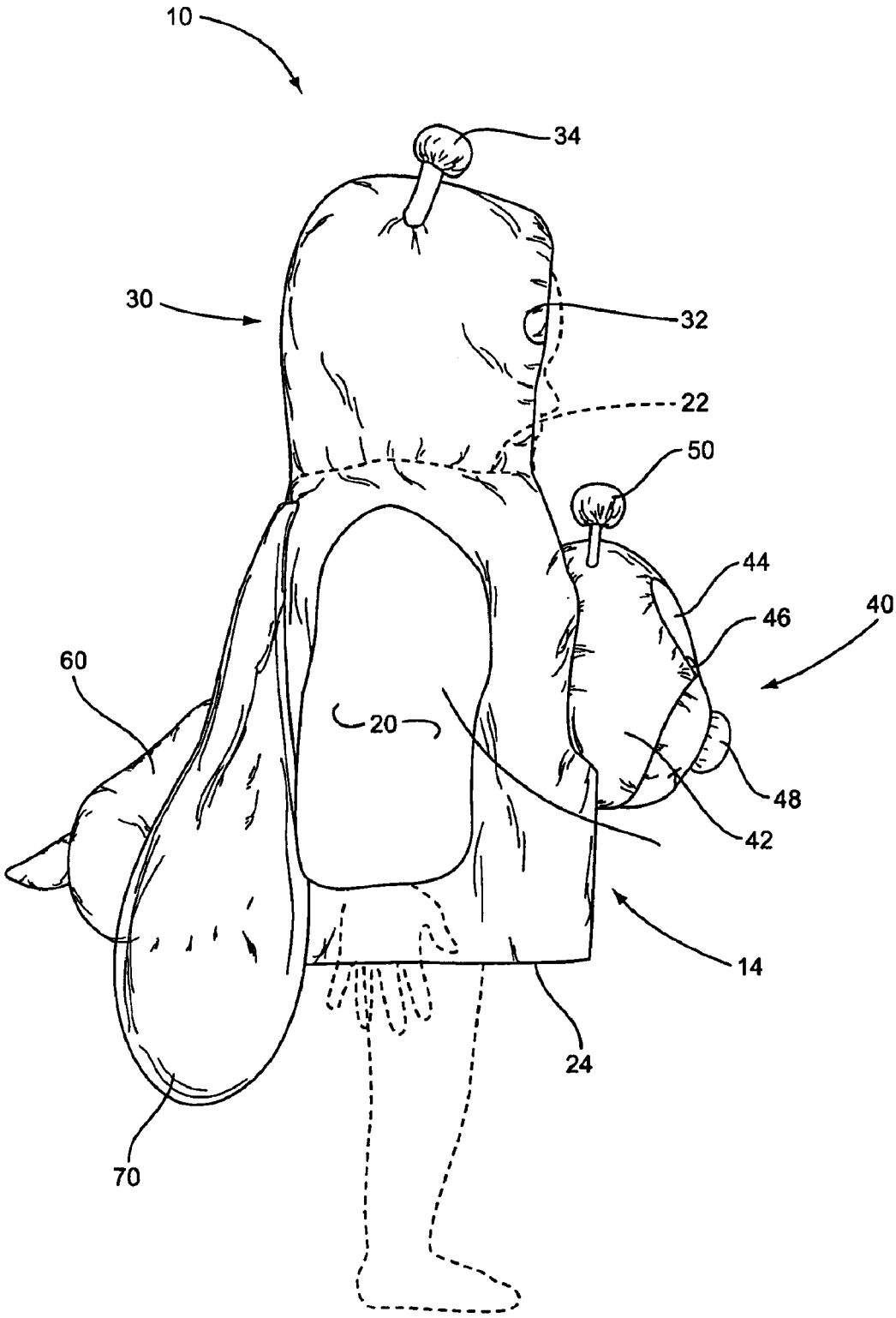
FIG. 2 is a side elevational view of the costume.
Figure 3:
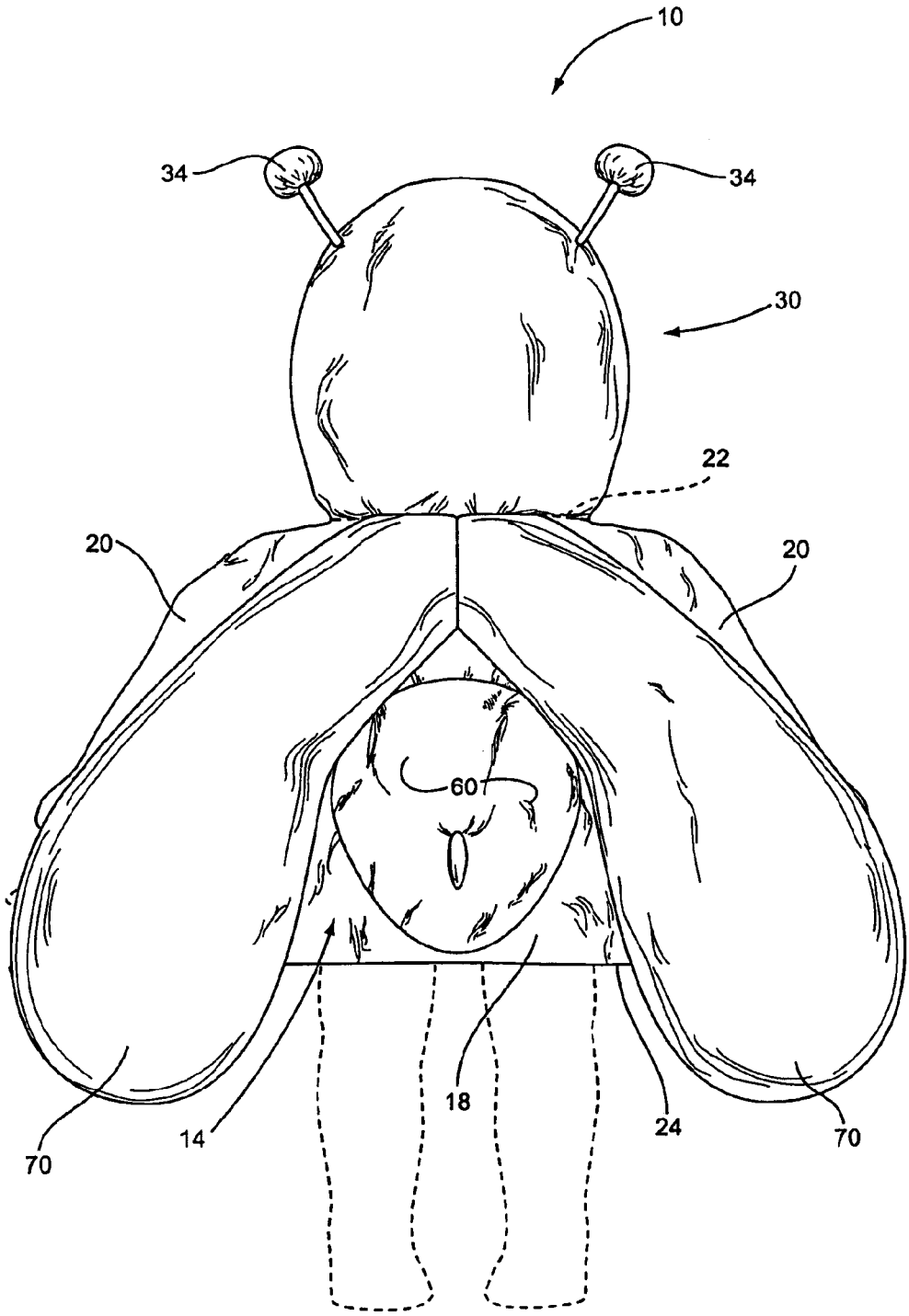
FIG. 3 is a rear elevational view of the costume.
Figure 4:
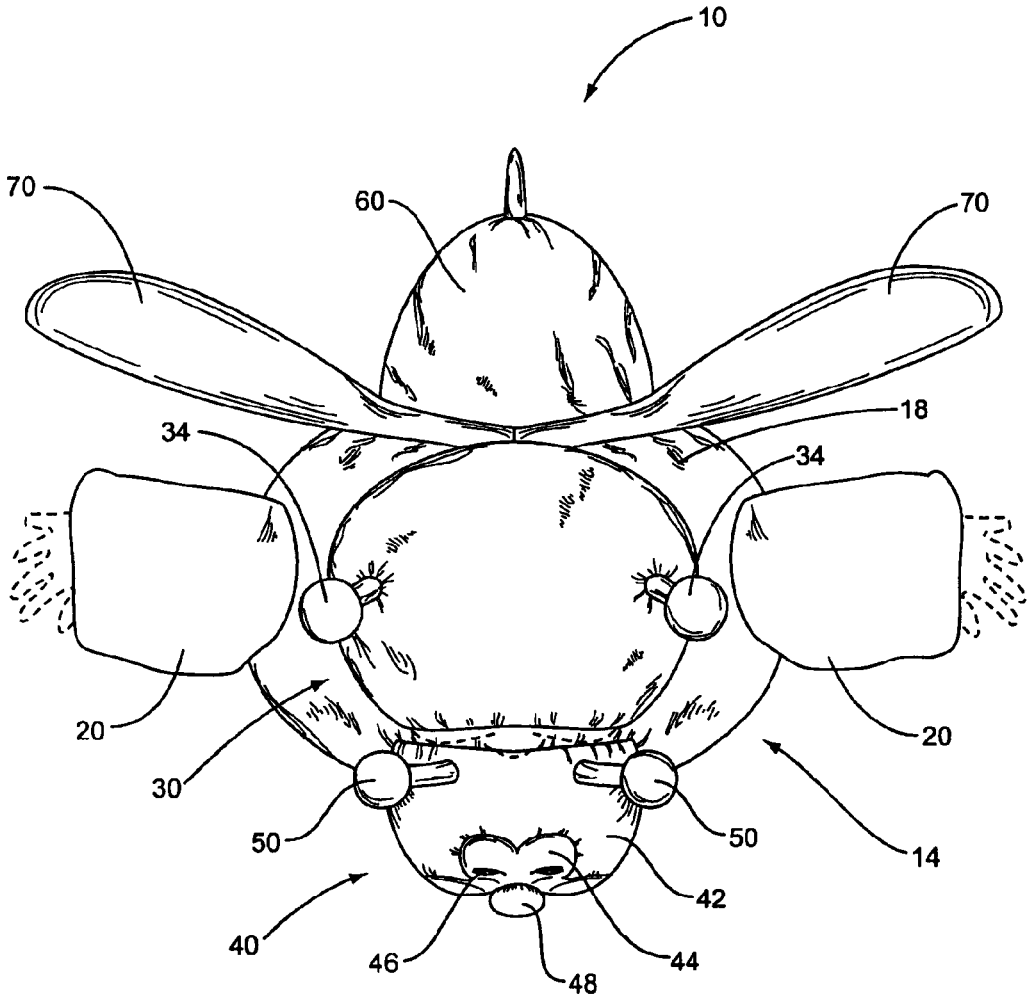
FIG. 4 is a top plan view of the costume.

Secured to the front 16 of the main body portion 14 is a head, which is indicated generally by the numeral 40. Head 40 can be secured to the front 16 in various ways such as by stitching, through hook and loop fasteners, clips, or zipper. In any event, as viewed in FIG. 1, the head 40 is secured to front 16 of the main body portion 14 below the neck opening 22 and below the head of a child 12. Head 40 includes an outer surface 42, which in turn includes a face area 44. Formed in the face area is a pair of eyes 46 and a nose 48. A pair of spaced apart antennas projects outwardly from the head 40. Head 40 is 3-dimensional and as viewed in FIG. 2 includes a height and a depth. As viewed in FIG. 1, the head includes a width. But, as viewed in FIG. 2 it is seen that the head 40 projects outwardly from the stomach or chest area of the child.

Head 40 may be constructed in many different ways. For example, it may be formed in the same manner as a stuffed toy or a plush toy would be formed. While the shape of the head 40 is generally round, it is appreciated that its shape could vary in order to change the expression projected by the head or to accommodate a particular fanciful representation of an animal, bug, insect, character or caricature. For example, the head 40 could be a fanciful representation of a lion, tiger, horse, cow, dog, cat, or could be a caricature or fanciful representation of a public human figure, such as a politician, movie star or sports personality.

Secured to the back 18 of the main body portion 14 is a tail 60. Tail 60 projects from the back and is positioned on the costume such that the head 40 and the tail 60 suggests that the two components form a part of an animal, bug or other type of creature or caricature. In addition to the tail 60, secured to the back 18 and extending therefrom is a pair of wings 70.

In the case of the present costume 10 that is disclosed in the drawings, the costume is a fanciful representation of a bumblebee. However, it should be understood, that the costume 10 of the present invention can represent many different types of animals, bugs, fanciful characters, caricatures and the like. The bumblebee is but one example of the present invention and is particularly one example of a costume having a head formed on the front panel of the main body of the costume.

Further, the costume 10 of the present invention can be made of various types and colors of fabric and can be adorned with many types of appendages that might represent portions of animals, bugs, fanciful characters and other types of caricatures.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A costume comprising:

a main body forming a part of the costume and having a front and a back, said main body adapted to be worn such that a body of a person lies between the front and the back;

a neck opening formed in a top of the main body, said neck opening adapted to fit around a neck of the person;

a hood having a face opening, said hood secured to at least a portion of the neck opening and extending upwardly from the main body, wherein when worn, the hood surrounds the person's head such that said face opening exposes at least a portion of the face of the person; and a head secured to the front of the main body and disposed below the hood, said head projecting outwardly from the main body and having an outer surface including a face, wherein said head is 3-dimensional and includes a height, width, and depth that is independent of the main body.

2. The costume of claim 1 further comprising a tail projecting from the back of the main body.

3. The costume of claim 1 further comprising a pair of wings projecting from the back of the main body.

4. The costume of claim 1 further comprising:

a tail projecting from the back of the main body, said tail positioned generally centrally on the back of the main body; and a pair of wings projecting from the back of the main body, said pair of wings positioned generally on a top portion of the back of the main body above the tail.

5. The costume of claim 1 further comprising a pair of antennae extending outwardly from a top portion of the hood.

6. The costume of claim 5 further comprising a pair of antennae positioned generally above the face and extending outwardly from the head.

7. The costume of claim 6 wherein the pair of antennae extending from the head matches the pair of antennae extending from the hood.

8. The costume of claim 1 wherein the head assumes a generally round shape.

9. The costume of claim 1 wherein the face of the head comprises an animal face.

10. The costume of claim 1 wherein the hood loosely surrounds the head of the person.

11. The costume of claim 1 wherein the main body and head form parts of the costume and form the appearance of an animal, and wherein the main body of the costume represents a substantial body portion of the animal and the head represents a head of the animal.

12. The costume of claim 11 further comprising a tail secured to and extending from the back of the main body, wherein the main body, head, and tail form parts of the costume and form the appearance of the animal and wherein the tail represents a tail of the animal.

* * * * *